United States Patent [19]

Regalbuto et al.

[11] Patent Number: 4,512,418

[45] Date of Patent: Apr. 23, 1985

[54] MECHANICALLY INITIATED TUBING CONVEYED PERFORATOR SYSTEM

[75] Inventors: John A. Regalbuto, Fort Worth; James B. Patton, Arlington; Cyril R. Sumner, Houston, all of Tex.

[73] Assignee: Halliburton Company, Duncan, Okla.

[21] Appl. No.: 515,821

[22] Filed: Jul. 21, 1983

[51] Int. Cl.[3] ..... E21B 43/1185

[52] U.S. Cl. ..... 175/4.56; 166/55.1; 102/322

[58] Field of Search ..... 175/4.56, 4.6, 4.53, 175/4.51, 4.54, 3.5, 2; 166/55, 55.1, 55.2, 297, 299; 102/318, 322; 89/1 C

[56] References Cited

U.S. PATENT DOCUMENTS

| | | | |
|---|---|---|---|
| 2,169,559 | 8/1939 | Halliburton | 175/4 |
| 2,456,977 | 12/1948 | McCullough | 175/4.56 |
| 2,530,966 | 11/1950 | Huber | 175/4.56 |
| 2,676,661 | 4/1954 | Crooke, Jr. | 166/318 |
| 2,745,495 | 5/1956 | Taylor | 166/297 |
| 2,760,408 | 8/1956 | Taylor | 175/4.54 |
| 2,873,675 | 2/1959 | Lebourg | 175/4.6 |
| 3,011,551 | 12/1961 | Young et al. | 175/4.52 |
| 3,291,207 | 12/1966 | Rike | 166/254 |
| 3,633,686 | 1/1972 | Bennett | 175/4.51 |
| 3,706,344 | 12/1972 | Vann | 166/297 |

OTHER PUBLICATIONS

"Explosive Cutter for Minesweeping", SA Marine Aktiebolag, Box 2001, 261 02, Lanoskrona, Sweden; HK 750419E-Brochure Number; from FFV Ordinance Division.

*Primary Examiner*—Stephen J. Novosad
*Assistant Examiner*—Hoang C. Dang
*Attorney, Agent, or Firm*—James R. Duzan

[57] ABSTRACT

A firing mechanism for a tubing conveyed well perforating system used for the completion of formations for both testing and production wherein the primary detonating mechanism of the firing mechanism includes a housing assembly, a capsule assembly retained within the housing assembly having an explosive contained therein adapted to detonate an explosive in the perforating gun of the perforating system, a booster assembly retained within the housing adapted to detonate the explosive in the capsule assembly, and a striker assembly retained by the striker assembly adapted to cause the detonation of the explosive in the booster assembly upon impact therewith.

8 Claims, 3 Drawing Figures

MECHANICALLY INITIATED TUBING CONVEYED PERFORATOR SYSTEM

BACKGROUND OF THE INVENTION

This invention relates to perforating system in general and, more specifically, to a tubing conveyed well perforating system having an improved firing mechanism.

In completing well bores, it is desirable to use a large diameter casing-type gun to efficiently perforate the casing and form passageways which extend into the formation through which formation fluids may flow into the casing. In many instances where it is desired to perforate long intervals of the formation, a series of sequentially connected perforating guns are run into a cased well bore on the end of a tubing string. In some instances, it may be desirable to isolate the formation during the perforating operation to minimize contamination of the formation by fluids in the casing and to subject the formation to a reduced pressure (below formation pressure) to encourage the rapid flow of formation fluid into the casing, after perforation of the casing, to attempt to wash or clean the perforations.

To accomplish the isolation of the formation from the fluids in the casing the perforating guns may be sequentially connected below a packer having a perforated nipple connected to the bottom thereof. When the string of perforating guns is connected below a packer having a perforated nipple connected to the bottom thereof, since the pressure in the well bore below the packer may be reduced by the control of the level of fluid in the tubing string used to convey the packer and perforating gun, a large pressure differential may exist between the interior of the perforated casing and the formation surrounding the perforated casing which may facilitate the formation fluids flowing into the casing washing or cleaning the perforations.

In some instances, when using tubing conveyed perforating guns, it may be desired to use a sinker bar having a firing mechanism attached thereto to actuate the perforating guns. Typically, when using a sinker bar to actuate a string of perforating guns, detonation of the guns is usually accomplished from the top gun of the series when the sinker bar detonates a primer cord explosive in the top gun which, in turn, detonates the shaped charges in the perforating guns.

Examples of tubing conveyed perforating guns are shown in U.S. Pat. Nos. 2,169,559; 2,530,966; 2,745,495; 3,011,551; and 3,291,207 while examples of tubing conveyed perforating guns which are actuated through the use of sinker bars are shown in U.S. Pat. Nos. 2,456,977; 2,760,408; and 3,706,344.

STATEMENT OF THE INVENTION

The present invention is directed to an improved firing mechanism for tubing conveyed well perforating systems of the type shown in U.S. Pat. No. 2,169,559. More specifically, a firing mechanism for a tubing conveyed well perforating system used for the completion of formations for both testing and production which system is actuated by a sinker bar having a portion of the firing mechanism secured thereto.

DETAILED DESCRIPTION OF THE INVENTION

Figure 1:
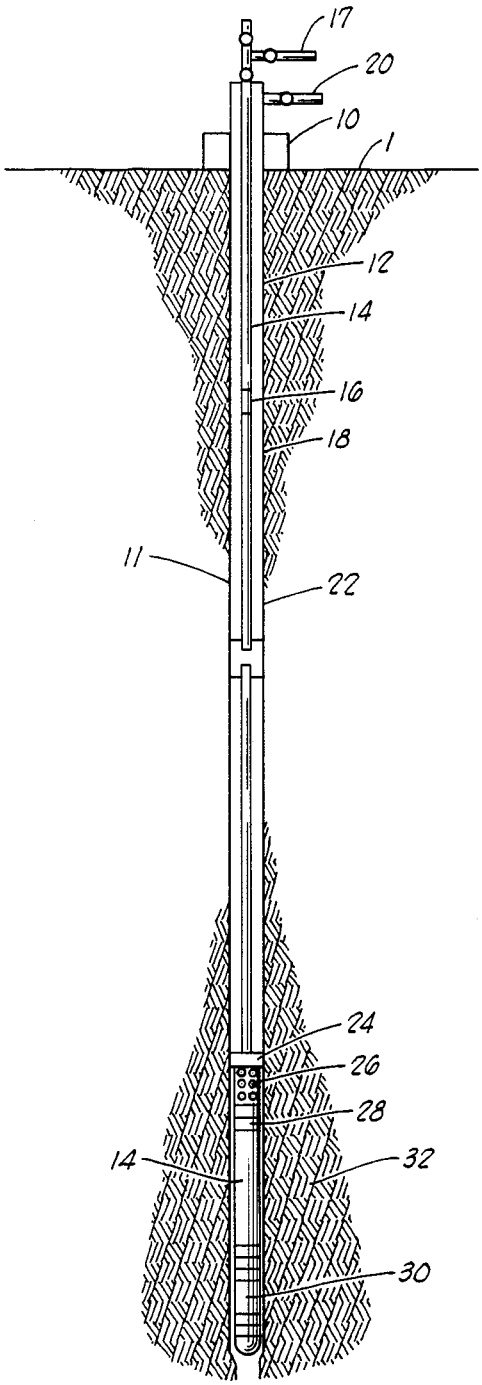
FIG. 1 is a view of the cross-section of the earth's surface having a borehole formed therein which has, in turn, a tubing conveyed perforation system which includes the present invention therein.

Referring to FIG. 1, the tubing conveyed completion system of the present invention is shown in a well bore.

A well head 10 is situated above the surface of the earth 1 and is connected to a casing 12 installed in well bore 11 through which tubing 14 is disposed forming an inner flow path 16 and an annular flow path 18 between the exterior of the tubing 14 and the interior of the casing 12.

The annular flow path 18 is connected to outlet 20 through which the flow of fluids into and from the flow path 18 may be controlled.

Typically, the casing 12 will be cemented into the earth 1 having an annular coating of cement 22 therearound and any voids between the casing 12 and well bore 11 in the earth filled with cement.

Connected to the lower end of tubing string 14 is a packer 24 used to seal the interior of the casing 12 so that one portion of the well bore 11 may be isolated from another. The packer 24 may be any suitable type, such as either a retrievable type or permanent type, depending upon whether or not the packer is to remain in the casing for production purposes or whether or not the completion system is to be used for completion and testing, etc.

A perforated nipple 26 is located below the packer 24 being releasably connected thereto and having any desired number of apertures therein to allow fluid communication from the exterior thereof with the interior of the tubing string 14. The perforated nipple 26 may include a frangible ceramic or other material member to keep debris from falling therebelow.

Optionally installed in the tubing string 14 below the nipple 26 is any suitable releasing tool 28, such as shown in U.S. Pat. No. 4,040,482, which may be used to release anything connected therebelow from anything connected thereabove.

Connected to the bottom of releasing tool 28, if used, or the bottom of nipple 26 is a perforating gun or jet perforating device 30. The perforating gun 30 is used to form perforations in the casing 12, annular cement coating 22 surrounding the casing 12 and in the earth 1 surrounding the well bore 11. The perforating gun may be any type which will provide communication between a hydrocarbon bearing formation 32 and the well bore 11.

Figure 2:
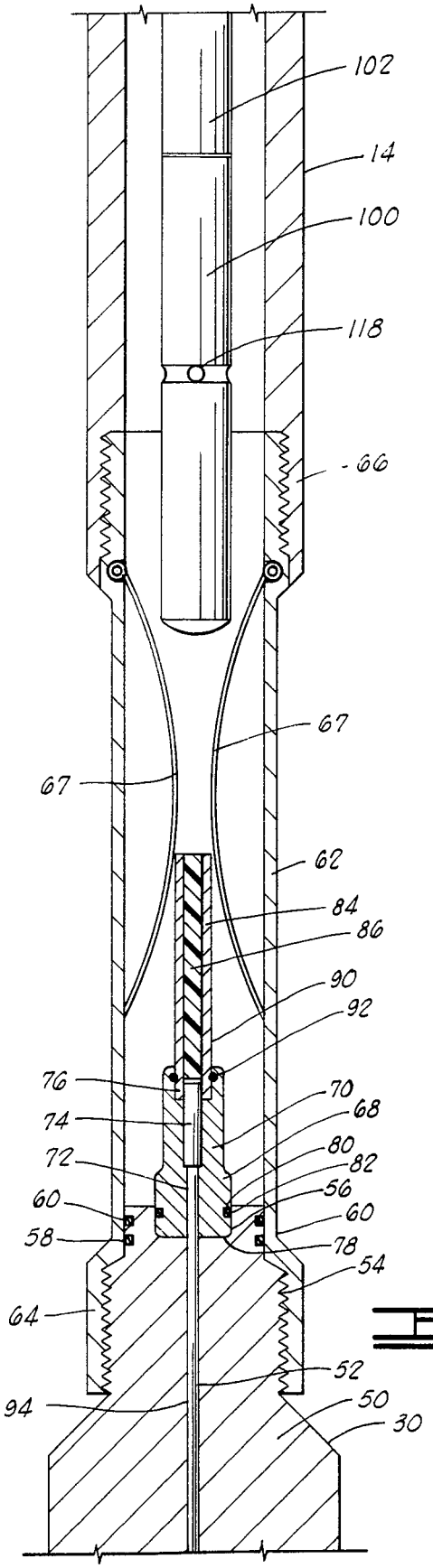
FIG. 2 is a cross-sectional view of the upper portion of perforating gun of a tubing conveyed perforation system utilizing the present invention.

Referring to FIG. 2, the firing mechanism for the tubing conveyed completion system of the present invention is shown.

As shown, the perforating gun 30 comprises a body 50 having a bore 52 extending through the upper portion thereof, threaded portion 54, threaded bore 56, a plurality of annular seal cavities 58 having annular seal means 60 located therein, tubing connector member 62 having one end 64 threadedly secured to threaded portion 54 while the other end 66 is threadedly secured to the end of a piece of tubing 14 connecting the perforating gun 30 to the packer 20 or releasing tool 28 and having a plurality of longitudinally extending resilient centralizer fingers 67 secured in the upper portion therein having a portion thereof surrounding the hollow cylindrical member 84 and connector plug 68 installed in threaded bore 56.

The connector plug 68 comprises a cylindrical plug body 70 having a first bore 72 partially extending therethrough, a second bore 74 extending partially therethrough, a third threaded bore 76 extending partially therethrough, a threaded end 78 which is received in threaded bore 56 of the perforating gun body 50 and annular recess 80 having annular seal means 82 therein.

Installed or retained in third threaded bore 76 of connector plug 68 is hollow elongated cylindrical member 84 having explosive means 86 retained therein, threaded end portion 88 which is received in third threaded bore 76 of connector plug 68 and annular recess 90 having annular seal means 92 therein.

Received and fixedly retained by crimping within bores 72 and 74 of connector plug 68 is detonating cord 94 which is actuated by explosive means 86 and actuates the explosive perforating jet charges (not shown) in the perforating gun 30.

Also shown in FIG. 2, is the primary detonating means 100 secured to sinker bar 102. The primary detonating means 100 causes the detonation of explosive means 86 in cylindrical member 84 upon impact therewith.

Figure 3:
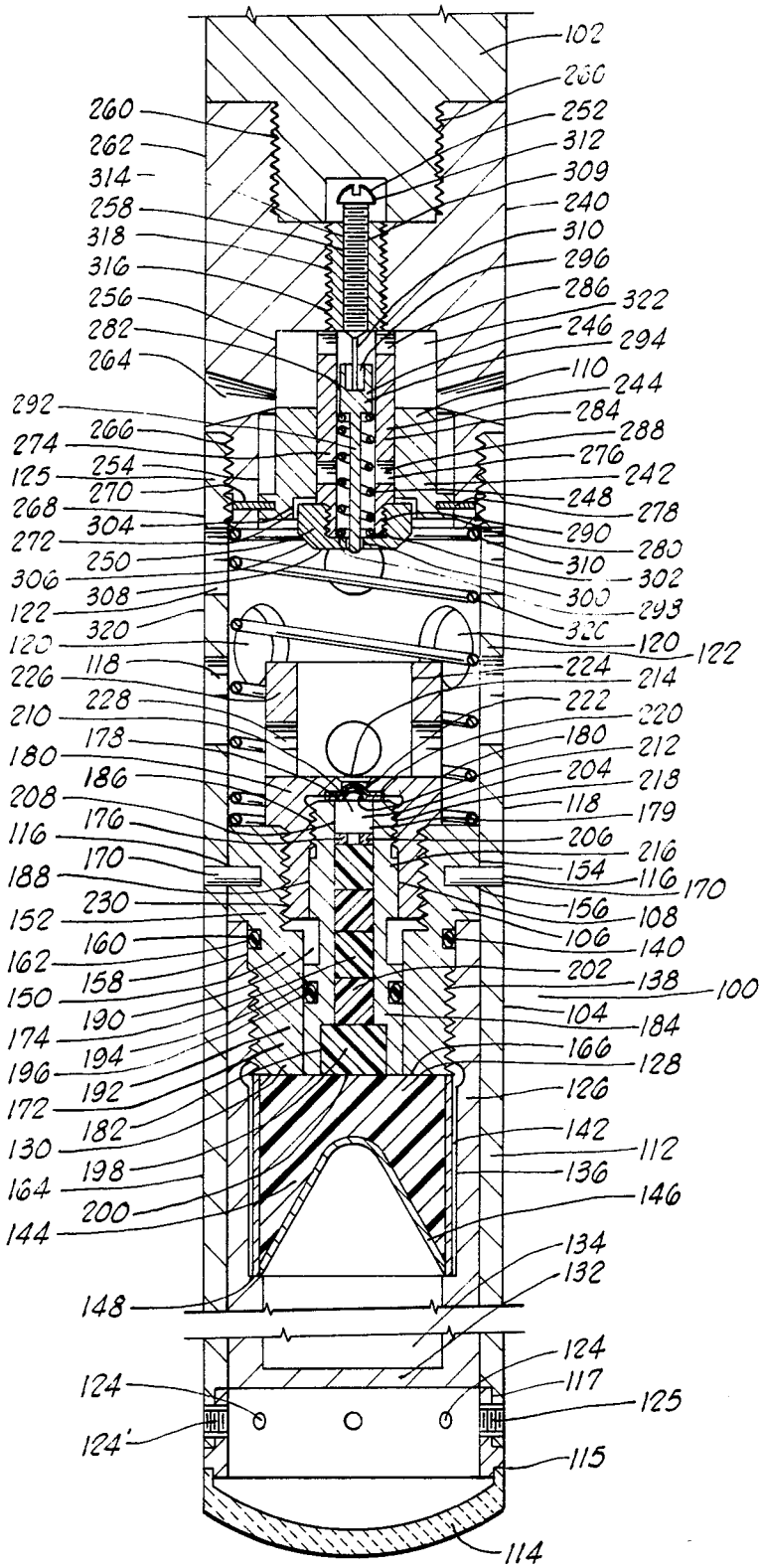
FIG. 3 is a cross-sectional view of the initiator assembly of the present invention.

Referring to FIG. 3, the primary detonating means 100 is shown in detail.

The primary detonating means 100 comprises elongated cylindrical housing assembly 104, capsule assembly 106, booster assembly 108 and striker assembly 110.

The elongated cylindical housing assembly 104 comprises cylindrical housing member 112 and frangible end 114 secured on one end thereof. The cylindrical housing member 112 is formed having a first plurality of apertures 116 therein, a second plurality of apertures 118 therein, a third plurality of apertures 120 therein, a fourth plurality of apertures 122 therein, an enlarged bore 123 having a fifth plurality of threaded apertures 124 therein and threaded bore 124' in one end thereof.

The frangible end 114 comprises a cylindrical housing member 115 having a reduced diameter exterior portion 117 having, in turn, a plurality of threaded apertures 124' therein which align with apertures 124 of member 112 and frangible end 118 secured to one end of member 115. The frangible end 114 is secured to housing member 112 by a plurality of threaded members 125 threadedly engaging threaded apertures 124 and 124'.

The capsule assembly 106 comprises capsule housing 126, explosive capsule 128 and capsule retainer 130.

The capsule housing 126 comprises an elongated annular cylindrical member having a closed end 132, first bore 134, larger second bore 136, threaded bore 138 and upper sealing bore 140.

The explosive capsule 128 comprises an annular cylindrical member 142 filled with explosive material 144 and frusto-conically shaped member 146 secured to one end of annular cylindrical member 142 which forms the explosive material 144 into a shaped explosive material. The particular type of explosive material 144 and the amount thereof used in the explosive capsule 128 vary depending upon a variety of factors well known to those skilled in the art. Generally, the frusto-conical shape of member 146 and its relationship to the explosive material 144 produce a successive collapse of the frusto-conically shaped member 146 upon detonation of the explosive material 144 progressing toward and along the axis of the member 146; i.e., the perforation axis. Consequently, upon the detonation of the explosive material 144 produces a relatively high velocity elongated jet comprising the collapsed frusto-conically shaped member 146 and hot gases which sever the closed end 132 of capsule housing 126. The explosive capsule 128 is retained within second bore 136 of the capsule housing 126 having one end thereof abutting annular shoulder 148 formed between first bore 134 and second bore 136 of the housing 126.

The capsule retainer 130 comprises an elongated annular cylindrical member having cylindrical bore 150 therein, threaded bore 152 on one end thereof, first cylindrical exterior portion 154 having, in turn, annular groove 156 therein, second cylindrical exterior portion 158 having, in turn, annular groove 160 therein containing annular seal means 162 therein, and threaded exterior portion 164 which threadedly engages threaded bore 138 of capsule housing 126. When capsule retainer 130 is assembled to capsule housing 126, annular end 166 of the retainer 130 abuts the end of explosive capsule 128 to retain the capsule 128 in position in the capsule housing 126.

To retain the capsule assembly 106 in position within the cylindrical housing assembly 104 a plurality of frangible shear pins 170 are inserted into apertures 116 so that one end of each pin 170 engages annular groove 156 of capsule retainer 130 while the other end thereof engages aperture 116.

The booster assembly 108 comprises the booster holder 172, booster explosive 174, booster insert 176, initiator 177, booster disk 178, and booster retainer 180.

The booster holder 172 comprises an elongated annular cylindrical member having, on the interior thereof, first cylindrical bore 182 and second smaller cylindrical bore 184 and, on the exterior thereof, threaded exterior portion 186, first cylindrical exterior portion 188, second cylindrical exterior portion 190 smaller than portion 188, and third cylindrical exterior portion 192 larger than portion 190, having, in turn, annular groove 194 therein which contains annular seal means 196 therein which sealingly engages cylindrical bore 150 of capsule retainer 130 when booster holder 172 is installed therein.

The booster explosive 174 comprises a plurality of booster explosive charges whose size and composition depend upon a variety of factors well known to those skilled in the art. Booster charge 198 is retained within first cylindrical bore 182 of booster holder 172 having one end thereof abutting the upper surface 200 of explosive material 144. The booster charges 202 are retained within second cylindrical bore 184 of booster holder 172 having their ends abutting each other or booster charge 198, except for the top charge 202 which has its upper surface abutting booster insert 176.

Booster insert 176 comprises an annular cylindrical member having a bore 204 therethrough.

Abutting the upper su4rface 206 of booster insert 176 is initiator 177.

Initiator 177 comprises a cylindrical housing 208 having a closed end 210 and an explosive material (not shown) therein whose size and composition depends upon a variety of factors well known to those skilled in the art.

Booster disk 178 comprises a circular metallic disk 212 having spherically shaped portion 214 therein. The booster retainer 180 is retained on the end of booster holder 172 having a portion of the bottom surface abutting the upper surface of initiator 177.

The booster retainer 180 comprises an elongated cylindrical member having, on the interior thereof, first cylindrical bore 216, threaded bore 218 which threadedly engages threaded exterior portion 186 of booster holder 172, second cylindrical bore 220 which receives the periphery of booster disk 178 therein, third cylindrical bore 222 which receives spherically shaped portion 214 of booster disk 178 therein, and fourth cylindrical bore 224 and, on the exterior thereof, cylindrical exterior portion 226 having, in turn, a plurality of apertures 228 therethrough allowing fluid communication between the exterior and interior of the booster retainer 180 and threaded exterior portion 230 which threadedly engages threaded bore 152 of capsule retainer 130.

The striker assembly 110 comprises the striker body 240, striker piston 242, striker housing 244, striker 246, striker spring 248, striker piston retainer 250, and limit screw 252.

The striker body 240 comprises an elongated cylindrical member having, on the interior thereof, first cylindrical bore 254, second cylindrical bore 256, first threaded bore 258 and second threaded bore 260 and, on the exterior thereof, first cylindrical exterior portion 262 having, in turn, a plurality of apertures 264 extending therethrough to allow fluid communication from the exterior of the striker body 240 to the interior thereof, threaded exterior portion 266 which threadedly engages threaded portion 125 of housing assembly 104 and second cylindrical exterior portion 268 having a plurality of apertures 270 therethrough extending into bore 254.

The striker piston 242 comprises an annular cylindrical member having, on the interior thereof, first cylindrical bore and second cylindrical bore 274 and, on the exterior thereof, first cylindrical exterior portion 276 and second cylindrical exterior portion 278 having, in turn, a plurality of apertures 280 therein, the portion 278 being slidably received within bore 254 of striker body 240.

The striker housing 244 comprises an elongated annular cylindrical member having a bore 282 through a portion thereof, threaded bore 314, first threaded exterior portion 316 which threadedly engages threaded bore 258 of striker body 240, cylindrical exterior portion 284 having, in turn, a first plurality of apertures 286, and a second plurality of apertures 288 therethrough allowing fluid communication between the exterior of the housing 244 to the interior thereof, a second plurality of apertures 287 and a second threaded exterior portion 290.

The striker 246 comprises an elongated cylindrical member having a cylindrical stem portion 292 and an enlarged cylindrical head 294 having a cylindrical recess or bore 296 therein. The cylindrical head 294 slidably engages bore 282 of the striker housing 244. The enlarged cylindrical head annular recess so that the seal means slidingly sealingly engage bore 282 of striker housing 244.

Disposed about the cylindrical stem portion 292 of the striker 246 is striker spring 248 having one end thereof abutting the lower surface 296 of head 294 of striker 246 while the other end abuts shoulder 298 of striker piston retainer 250.

The striker piston retainer 250 comprises an annular cylindrical member having, on the interior, cylindrical bore 300 which receives the stem portion 292 of striker 246 therein and threaded bore 302 which threadedly engages threaded exterior portion 290 of the striker housing 244 and, on the exterior, cylindrical exterior portion 304 which is received within bore 274 of striker piston 242, annular chamfered shoulder 306 and end surface 308.

To retain striker piston 242, striker housing 244, striker 246, striker spring 248, and striker piston retainer 250 within a first position within striker body 240 a plurality of frangible shear pins 310 are installed in apertures 270 of the striker body 240 having one end thereof engaging apertures 280 of striker piston 242.

The limit screw 252 comprises an elongated threaded cylindrical member having a threaded portion 309, cylindrical extension 310, a portion of which is received within recess 296 in the head 294 of striker 246 with the end of extension 310 abutting the head 294 and enlarged head 312. The threaded portion 309 of limit screw 252 threadedly engages threaded bore 314 of striker housing 244 whose first threaded exterior portion 316 threadedly engages threaded bore 258 of striker body 240.

To resiliently bias capsule assembly 106 in position within cylindrical housing assembly 104 a coil spring 320 is installed between capsule assembly 106 and striker assembly 110.

Received within threaded bore 260 of striker body 240 is a threaded portion of sinker bar 102. The sinker bar 102 may be of any desired shape and weight such that the primary detonating means 100 and the sinker bar 102 develop sufficient energy when falling through the tubing 14 to actuate the primary detonating means 100 upon impact with the perforating gun 30.

Operation of the Invention

Referring again to FIG. 1, when the tubing conveyed completion system of the present invention is placed in a well bore 11 before the perforating gun 30 may be actuated it is necessary to fill via valve 17 a portion of the tubing string 14 extending above the gun 30 with fluid, typically twenty-five (25) feet or as much as desired.

Referring to FIG. 2, when the tubing string 14 located above the perforating gun 30 is filled with fluid, the tubing connector member 62 of the gun 30 contains fluid thereby immersing the plug body 70 of the gun 30 and the attached cylindrical member 84 having explosive means 86 therein. As the primary detonating means 100 having sinker bar 102 attached thereto free falls through the tubing string 14 when it contacts the fluid in the tubing string 14, the fluid flows into primary detonating means 100 through ports 118 and 264 therein.

Referring to FIG. 3, when the primary detonating means 100 contacts cylindrical member 84 attached to plug body 70 of perforating gun 30 by the spring centralizer finger means guiding the detonating means 100 into contact with the member 84, the cylindrical member 84 fractures frangible end 114 of cylindrical housing assembly 104 coming into engagement with the closed end 132 of capsule housing 126. As the primary detonating means 100 continues its downward movement with respect to the perforating gun 30 the cylindrical member 84 attached to plug body 70 of gun 30 causes frangible shear pins 170 retaining capsule assembly 106 within the cylindrical housing assembly 104 to shear thereby allowing capsule assembly 106 to move upwardly in housing assembly 104 compressing spring 320 as it moves upwardly.

Upon sufficient upward movement of capsule assembly 106, the upper end of booster retainer 180 engages the bottom of striker piston 242 with the continued upward movement of capsule assembly 104 causing the frangible shear pins 310 retaining striker piston 242 within striker body 240 to be sheared thereby allowing the striker piston to move upwardly within the striker body 240.

Since fluid from the tubing string 14 flowed through apertures 264 filling annular cavity 322 formed between striker piston 242 and striker body 240, when the striker piston 242 moves upwardly to close off apertures 264, the upward movement of striker piston 242 causes fluid to flow from annular cavity 322, through apertures 286 in striker housing 244 into bore 282 thereby causing striker 246 to be driven downwardly within bore 282 compressing striker spring 246. The striker 246 moves downwardly within bore 282 from the action of the fluid flowing into bore 282 of striker housing 244 until the cylindrical head 294 of the striker 246 passes apertures 288 in striker housing 244 thereby allowing fluid entering bore 282 to exit bore 288 since striker piston 242 has moved sufficiently upwardly with respect to striker housing 244 to uncover apertures 288 to allow fluid flow therethrough.

As the striker 246 moves downwardly since booster retainer 180 engages the bottom of striker piston 242 and is moving upwardly, the stem portion 292 of the striker 246 pierces booster disk 178 striking initiator 177 causing the initiator 177 to detonate which, in turn, causes the detonation of booster explosive 174 which, in turn, detonates explosive capsule 128. When explosive capsule 128 detonates, the relatively high velocity elongated jet comprised of the collapsed frusto-conically shaped member 146 and hot gases emanating therefrom cut or sever closed end 132 of capsule housing and flow into or against the explosive means 86 in cylindrical member 84 attached to connector plug 68 of perforating gun 30 with sufficient force to cause the detonation of explosive means 86 which, in turn, causes the detonating cord 94 to detonate which, in turn, cause the detonation of the shaped charges in the perforating gun 30.

Since the shaped charges in the perforating gun 30 are actuated by the detonating cord 94, any number of perforating guns 30 may be connected together by connecting the detonating cord 94 of each gun 30 to the perforating gun above and below it.

It should be noted that the tubing conveyed completion system of the present invention has many desirable features. For instance, since the primary detonating means 100 requires a fluid environment to operate and has its operating components shear pinned in position within, it is safe to handle. Similarly, since the shaped charges in the perforating gun 30 are actuated by detonating cord, it is relatively simple and easy to connect two or more guns together to form a series of guns which may be actuated by actuating the top gun of the series.

It should be understood that the explosives and detonating devices used in the primary detonating means and the perforating gun 30 are to be selected based upon the operating temperatures to which the completion system is to be exposed.

After the perforating gun 30 has been actuated, any fluids contained in the formation 32 will flow into the well bore 11, through nipple 26 into the tubing 14. If desired, the releasing tool 28 may be actuated to drop the perforating gun 30 down the well bore 11 to allow formation fluids to flow directly into the nipple 26, through packer 24 into the tubing 14.

It will be evident to those skilled in the art from the foregoing specification and drawings that changes may be made in the completion system of the present invention which, although not described herein, function in the same manner as the apparatus described and method of operation of the apparatus described, are the equivalents thereof and fall within the scope of the present invention.

Having thus described our invention, we claim:

1. A tubing conveyed completion system comprising:

tubing means extending from the surface of the earth down a well bore to a location therein;

perforating gun means connected to one end of the tubing means, the perforating gun means including:

body means;

detonating cord means extending from the top of the body means through a portion thereof;

connector plug means secured to the top of the body means having one end of the detonating cord means secured therein;

hollow elongated cylindrical member means secured to the connector plug means;

explosive means retained within the hollow elongated cylindrical member means;

tubing connector member means having one end connected to the body means and the other end connected to the tubing means, the tubing connector means including:

spring centralizer finger means disposed within the upper portion of the tubing connector member means having a portion thereof surrounding the hollow elongated cylindrical member means adapted to guide the weight actuated primary detonating means into contact with the hollow elongated cylindrical member means; and weight actuated primary detonating means adapted to move through the tubing means, contact the perforating gun means, and cause the detonation of the explosive means retained within the hollow elongated cylindrical member means and the detonating cord means of the perforating gun means.

2. The tubing conveyed completion system of claim 1 wherein the weight actuated primary detonating means comprises:

housing assembly means;

capsule assembly means retained within the housing assembly means, the capsule assembly means having an explosive means therein adapted to detonate the explosive means retained within the hollow elongated cylindrical member means of the perforating gun means;

booster assembly means retained within the housing assembly means and having an explosive means therein, the explosive means in the booster assembly means adapted to detonate the explosive means in the capsule assembly means which is, in turn, adapted to detonate the explosive means within the hollow elongated cylindrical member means of the perforating gun means which is, in turn, adapted to detonate the detonating cord means of the perforating gun means; and striker assembly means retained by the housing assembly means, the striker assembly means adapted to cause the detonation of the explosive means of the booster assembly means upon impact therewith whereby upon the impact of the striker assembly means causes the detonation of the explosive means of the booster assembly means whereupon the detonation of the explosive means of the booster assembly means, in turn, causes the detonation of the explosive means in the capsule assembly means which, in turn, causes the detonation of the explosive means within the hollow elongated cylindrical member means of the perforating gun means which, in turn, causes the detonation of the detonating cord means.

3. The tubing conveyed completion system of claim 2 wherein the housing assembly means comprises:

cylindrical housing member means having on one end thereof a frangible end secured thereto, a plurality of apertures therein and a threaded bore in the other end thereof.

4. The tubing conveyed completion system of claim 3 wherein the capsule assembly means comprises:

capsule housing means retained within the housing assembly means;

explosive capsule means retained within the capsule housing means; and capsule retainer means secured to one end of the capsule housing means retaining the explosive capsule means within the capsule housing means.

5. The tubing conveyed completion system of claim 4 wherein the booster assembly means comprises:

booster holder means;

booster explosive means contained within the booster holder means;

booster insert means contained within the booster holder means overlying the booster explosive means;

initiator means contained within the booster holder means overlying the booster explosive means;

booster disk means; and booster retainer means secured to one end of the booster housing means.

6. The tubing conveyed completion system of claim 5 wherein the striker assembly means comprises:

striker body means;

striker piston means slidably retained within the striker body means;

striker housing means contained within the striker body means;

striker means slidably disposed within the striker housing means;

striker spring means resiliently biasing the striker means in a first position in the striker housing means;

striker piston retainer means secured to the striker housing means retaining the striker means within the striker housing means; and limit screw means threadedly engaging a portion of the striker housing means having a portion thereof engaging a portion of the striker means for adjusting the position of the striker means within the striker housing means.

7. A tubing conveyed completion system comprising:

tubing means extending from the surface of the earth down a well bore to a location therein;

perforating gun means connected to one end of the tubing means, the perforating gun means including: body means;

detonating cord means extending from the top of the body means through a portion thereof;

connector plug means secured to the top of the body means having one end of the primer cord means secured therein;

hollow elongated cylindrical member means secured to the connector plug means;

explosive means retained within the hollow elongated cylindrical member means;

tubing connector means having one end connected to the body means, the other end connected to the tubing means, and spring centralizer finger means disposed within the upper portion thereof having, in turn, a portion thereof surrounding the hollow elongated cylindrical member means; and weight actuated primary detonating means adapted to move through the tubing means, the weight actuated primary detonating means comprising:

housing assembly means;

capsule assembly means retained within the housing assembly means, the capsule assembly means having an explosive means therein adapted to detonate the explosive means retained within the hollow elongated cylindrical member means of the perforating gun means;

booster assembly means retained within the housing assembly means and having an explosive means therein, the explosive means in the booster assembly means adapted to detonate the explosive means in the capsule assembly means which is, in turn, adapted to detonate the explosive means within the hollow elongated cylindrical member means of the perforating gun means which is, in turn, adapted to detonate the detonating cord means of the perforating gun means; and striker assembly means retained by the housing assembly means, the striker assembly means adapted to cause the detonation of the explosive means of the booster assembly means upon impact therewith whereby upon the impact of the striker assembly means causes the detonation of the explosive means of the booster assembly means whereupon the detonation of the explosive means of the booster assembly means, in turn, causes the detonation of the explosive means in the capsule assembly means which, in turn, causes the detonation of the explosive means within the hollow elongated cylindrical member means of the perforating gun means which, in turn, causes the detonation of the detonating cord means.

8. The tubing conveyed completion system of claim 7 wherein:

the housing assembly means comprises:

cylindrical housing member means having on one end thereof a frangible end secured thereto, a plurality of apertures therein and a threaded bore in the other end thereof;

the capsule assembly means comprises:

capsule housing means retained within the housing assembly means;

explosive capsule means retained within the capsule housing means; and capsule retainer means secured to one end of the capsule housing means retaining the explosive capsule means within the capsule housing means;

the booster assembly means comprises:

booster holder means;

booster explosive means contained within the booster holder means;

booster insert means contained within the booster holder means overlying the booster explosive means;

initiator means contained within the booster holder means overlying the booster explosive means;

booster disk means; and booster retainer means secured to one end of the booster housing means; and the striker assembly means comprises:

striker body means;

striker piston means slidably retained within the striker body means;

striker housing means contained within the striker body means;

striker means slidably disposed within the striker housing means;

striker spring means resiliently biasing the striker means in a first position in the striker housing means;

striker piston retainer means secured to the striker housing means retaining the striker means within the striker housing means; and limit screw means threadedly engaging a portion of the striker housing means having a portion thereof engaging a portion of the striker means for adjusting the position of the striker means within the striker housing means.

* * * * *

UNITED STATES PATENT AND TRADEMARK OFFICE

CERTIFICATE OF CORRECTION

PATENT NO. : 4,512,418

DATED : Apr. 23, 1985

INVENTOR(S) : Regalbuto et al.

It is certified that error appears in the above-identified patent and that said Letters Patent is hereby corrected as shown below:

In column 4, line 59, delete the word [su4rface] and insert therefor --surface--.

Signed and Sealed this

*Seventeenth* Day of *September 1985*

[SEAL]

*Attest:*

DONALD J. QUIGG

*Attesting Officer*

*Commissioner of Patents and Trademarks—Designate*